US006655065B1

(12) United States Patent
Chapman

(10) Patent No.: US 6,655,065 B1
(45) **Date of Patent: *Dec. 2, 2003**

(54) BARREL CATCH MECHANISM

(76) Inventor: Daniel L. Chapman, P.O. Box 710316, Santee, CA (US) 92072-0316

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/962,232

(22) Filed: Nov. 1, 1997

(51) Int. Cl.[7] ..... F41A 3/00; F41C 3/14
(52) U.S. Cl. ..... 42/44; 42/64
(58) Field of Search ..... 42/40, 44, 63, 42/64, 26, 14, 7, 75, 75.02, 75.03, 2

(56) References Cited

U.S. PATENT DOCUMENTS

| | | | | | |
|---|---|---|---|---|---|
| 26,364 | A | * | 12/1859 | Maynard | 42/40 |
| 44,123 | A | | 9/1864 | Stevens | 42/46 |
| 44,312 | A | * | 12/1864 | Hillis | 42/40 |
| 149,352 | A | * | 4/1874 | Sneider | 42/44 |
| 161,307 | A | * | 3/1875 | Watson | 42/40 |
| 216,012 | A | * | 6/1879 | Bader | 42/40 |
| 255,330 | A | * | 3/1882 | Pierce | 42/40 |
| 339,301 | A | | 4/1886 | Johnson et al. | 42/65 |
| 353,914 | A | * | 12/1886 | Boland | 42/63 |
| 368,599 | A | | 8/1887 | Marlin | 42/64 |
| 370,926 | A | * | 10/1887 | Caldwell | 42/63 |
| 413,975 | A | * | 10/1889 | Smith | 42/63 |
| 452,126 | A | * | 5/1891 | Torkelson | 42/40 |
| 572,520 | A | * | 12/1896 | Blanchard | 42/40 |
| 604,273 | A | * | 5/1898 | Solodovnikoff | 42/44 |
| 604,488 | A | * | 5/1898 | Cashmore | 42/40 |
| 624,620 | A | * | 5/1899 | Brown | 42/44 |
| 674,086 | A | * | 5/1901 | Hanson | 42/40 |
| 763,467 | A | * | 6/1904 | Day | 42/40 |
| 889,279 | A | * | 6/1908 | Warnant | 42/44 |
| 893,465 | A | * | 7/1908 | Durham | 42/40 |
| 1,004,269 | A | * | 9/1911 | Jager | 42/40 |
| 1,348,545 | A | * | 8/1920 | Curtis | 42/44 |
| 4,299,046 | A | * | 11/1981 | Atchisson | 42/40 |
| 4,489,515 | A | * | 12/1984 | Numbers | 42/40 |

FOREIGN PATENT DOCUMENTS

| | | | | |
|---|---|---|---|---|
| DE | 232304 | * | 8/1910 | 42/63 |

* cited by examiner

*Primary Examiner*—Michael J. Carone
*Assistant Examiner*—Denise J Buckley

(57) ABSTRACT

A barrel catch mechanism particularly suited to small hinged barrel handguns. A transversely slidable locking piece engages a barrel lug. The locking piece has a stud which engages an aperture in the lug. Locking and unlocking is controlled by a spring loaded actuator extending through the frame.

20 Claims, 13 Drawing Sheets

BARREL CATCH MECHANISM

BACKGROUND

1. Field of Invention

This invention relates to firearms, specifically to the barrel catch mechanism of a small handgun.

2. Description of Prior Art

Barrel catch mechanisms for handguns have a long history. Hinged barrel revolvers typically use a catch which locks the topstrap to the frame. This catch usually consists of a rotating member; however, a push button type is also shown in U.S. Pat. No. 368,599 (Marlin).

Hinged barrel pistols, which often do not use a topstrap, show a greater variety of barrel catch configurations. Among the barrel catches used in hinged barrel pistols are the rotating cam of the Remington double derringer, the rotating stirrup of the High Standard derringer, the sliding catch of the COP .357, the triggerguard actuated catch of the Thompson/Center Contender, and the push button catch of U.S. Pat. No. 44,123(Stevens). Hinged barrels are comparatively rare in self loading pistols; however, a frame mounted rotating catch is used in the Le Francais self loading pistols, as well as in some current Beretta and Taurus models.

Although the prior art is filled with barrel catches for hinged barrel handguns, heretofore known barrel catch mechanisms suffer from a number of disadvantages, particularly when applied to small handguns:

(a) Compact barrel catch mechanisms suitable for small handguns provide low strength and thereby limit the gun to the use of low energy cartridges.

(b) Robustly designed barrel catch mechanisms offering high strength use comparatively large components, or, are otherwise not readily adaptable to small handguns.

(c) Known barrel catches are ergonomically difficult to operate when miniaturized.

(d) Known barrel catches may interfere with the comfortable gripping of a small handgun.

(e) Barrel catch mechanisms located above the bore axis, or requiring a hinge above the bore axis, needlessly increase overall handgun height.

OBJECTS AND ADVANTAGES

Accordingly, among the objects and advantages of the present invention are:

(a) to provide a barrel catch mechanism suitable for small handguns which offers robustness and the strength to contain high energy cartridges.

(b) to provide a barrel catch mechanism which is ergonomically easy to operate.

(c) to provide a barrel catch mechanism which does not interfere with the comfortable gripping of a small handgun.

(d) to provide a barrel catch mechanism which is not a design constraint to minimizing handgun height.

DRAWING FIGURES

REFERENCE NUMERALS IN DRAWING

| | |
|---|---|
| 1 | Single shot pistol |
| 2 | Left grip plate |
| 3 | Frame |
| 4 | Triggerguard |
| 5 | Barrel |
| 6 | Right grip plate |
| 7 | Hinge pin |
| 9 | Forward lug |
| 11 | Rear lug |
| 12 | Barrel bore |
| 13 | Aperture |
| 15 | Forward well |
| 17 | Rear well |
| 19 | Locking piece |
| 21 | Locking stud |
| 23 | Actuator |
| 25 | Bottom radius of rear lug |
| 27 | Front radius of rear lug |
| 29 | Rear radius of rear lug |
| 30 | Rear radius of forward lug |
| 31 | Front radius of rear well |
| 32 | Rear radius of forward well |
| 33 | Rear radius of rear well |
| 35 | Top radius of catch |
| 37 | Bottom radius of catch |
| 39 | Threaded through hole |
| 41 | Threaded |
| 43 | end of actuator |
| 45 | Push button |
| 47 | Through hole |
| 49 | Counterbore |
| 51 | Recess |
| 53 | Compression spring |
| 55 | Camming surface |

Description—FIGS. 1 to 13

Figure 1:
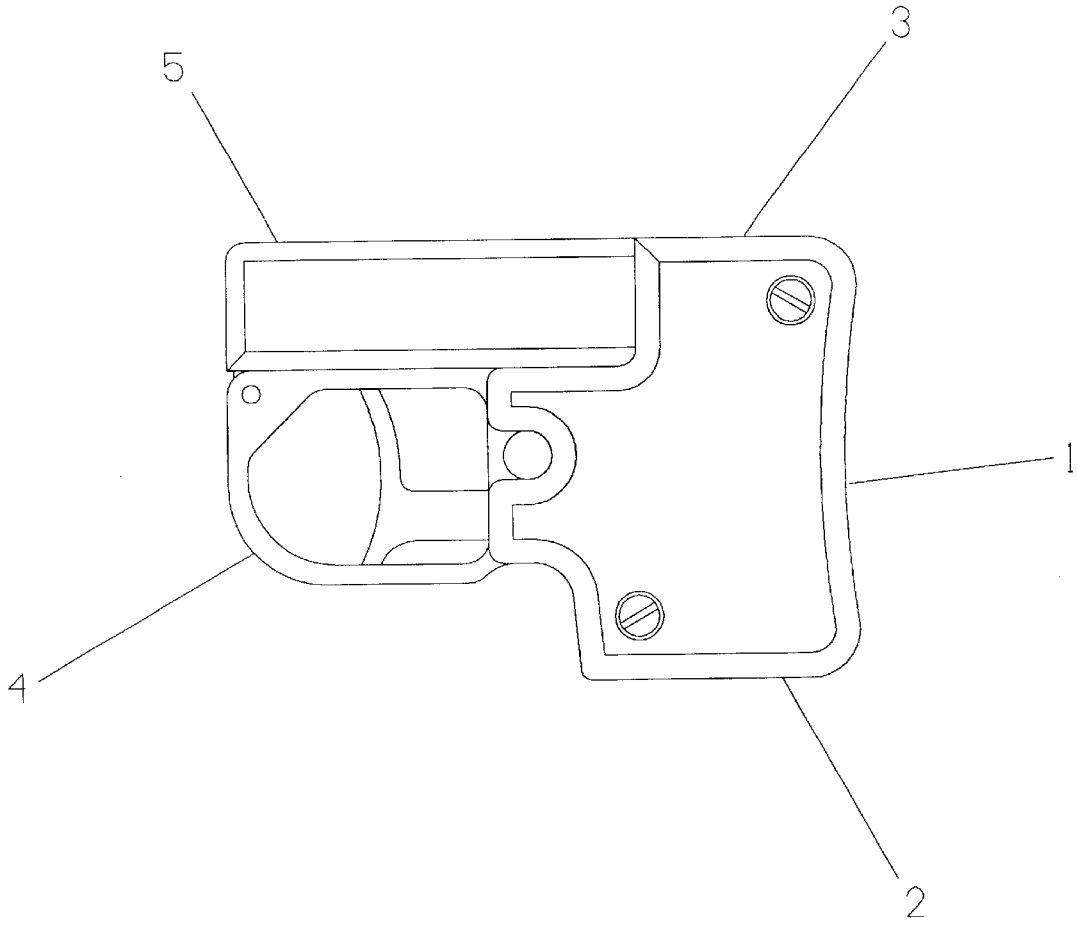
FIG. 1 is a left side view of a single shot pistol incorporating the invention.
Figure 2:
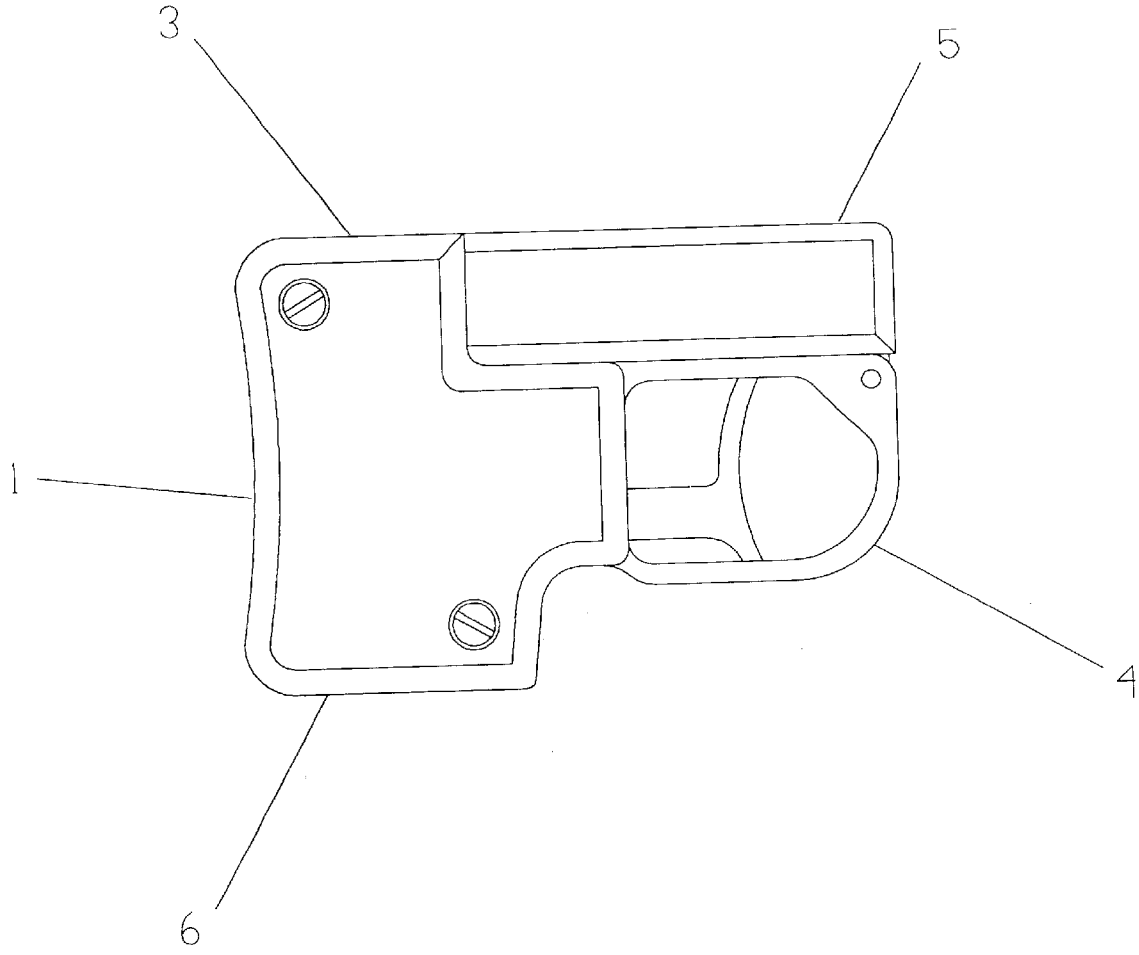
FIG. 2 is a right side view of a single shot pistol incorporating the invention.

FIGS. 1 and 2 show a single shot pistol 1 which incorporates the present invention. Pistol 1 has a frame 3 with an integral triggerguard 4, a left grip plate 2, a right grip plate 6, and a hinged barrel 5. A comparable pistol is disclosed in U.S. Patent applications titled "Passive Safety Mechanism" and "Firing Mechanism" filed Oct. 31, 1997 which are hereby incorporated by reference in their entirety herein.

Figure 4:
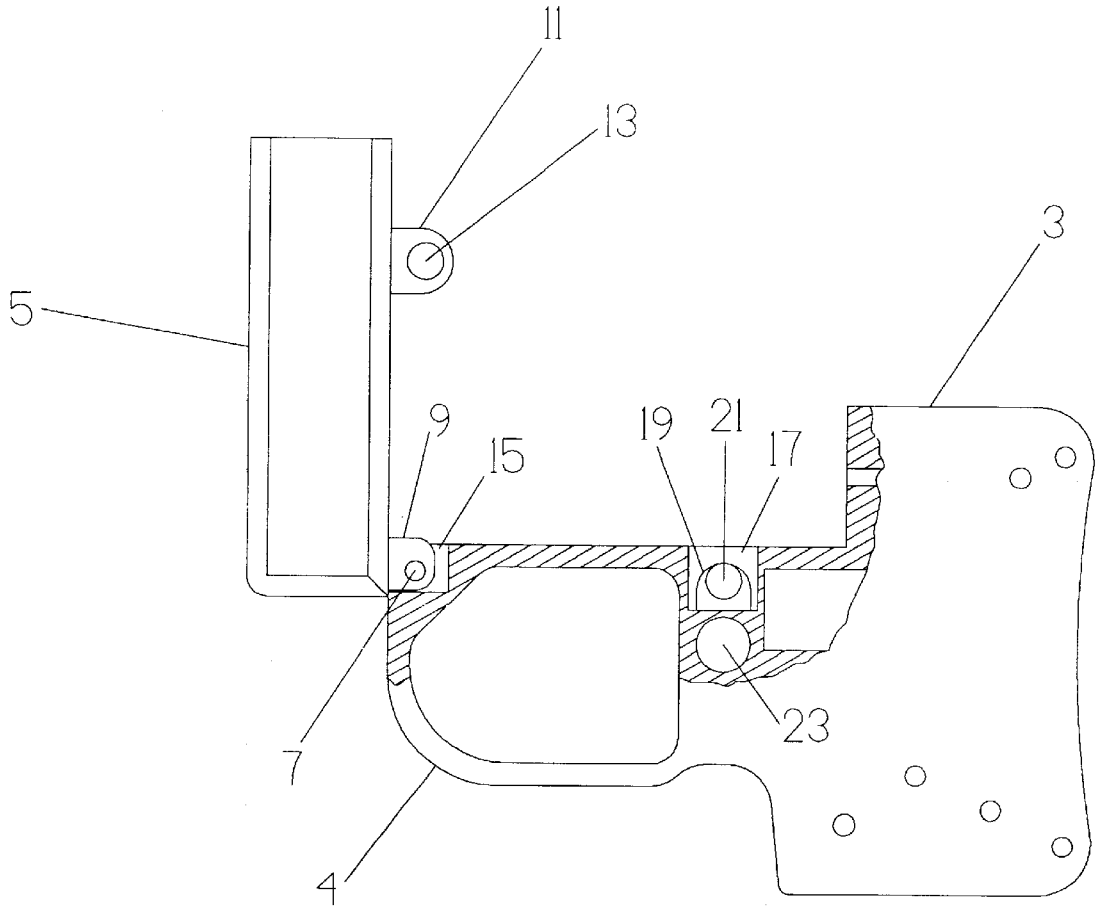
FIG. 4 is a partional sectional left side view with barrel unlocked.

FIG. 4 shows barrel 5 in the loading position. Barrel 5 has a forward lug 9. Barrel 5 is connected to frame 3 by a hinge pin 7 which passes through forward lug 9 and triggerguard 4. Barrel 5 also has a rear lug 11. Rear lug 11 is an underlug with a transverse aperture 13. Triggerguard 4 has a forward well 15 which accepts forward lug 9 of barrel 5. Frame 3 also has a rear well 17 which is transversely accessible to a locking piece 19. Locking piece 19 has a cantilever locking stud 21 and is controlled by a spring loaded actuator 23.

Figure 3:
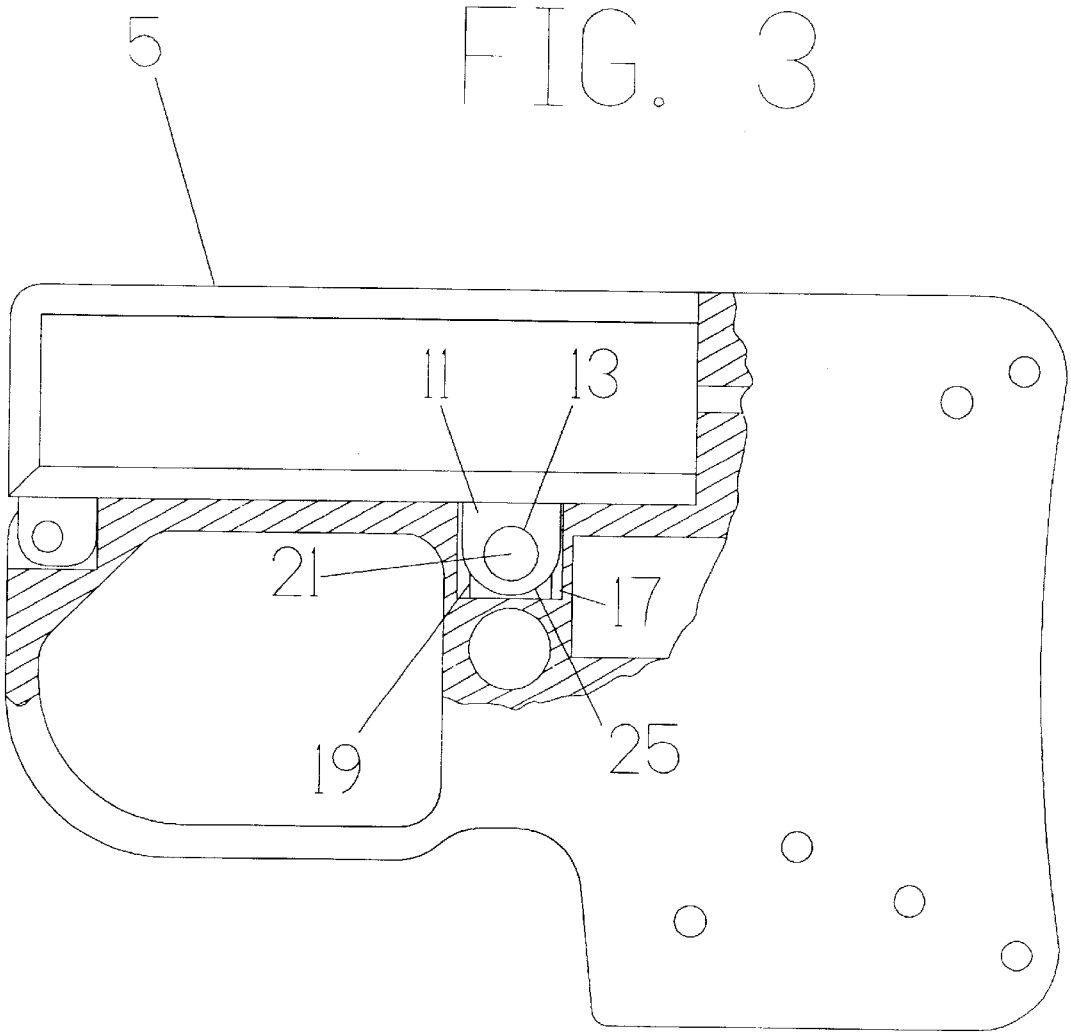
FIG. 3 is a partial sectional left side view with barrel locked and rotated into loading position.

FIG. 3 shows that rear lug 11 is accepted by rear well 17. Rear lug 11 incorporates a bottom radius 25 in order to avoid interference with rear well 17 during rotation of barrel 5. With barrel 5 rotated into the battery position as shown, locking stud 21 of locking piece 19 engages rear lug 11 through aperture 13.

Figure 7:
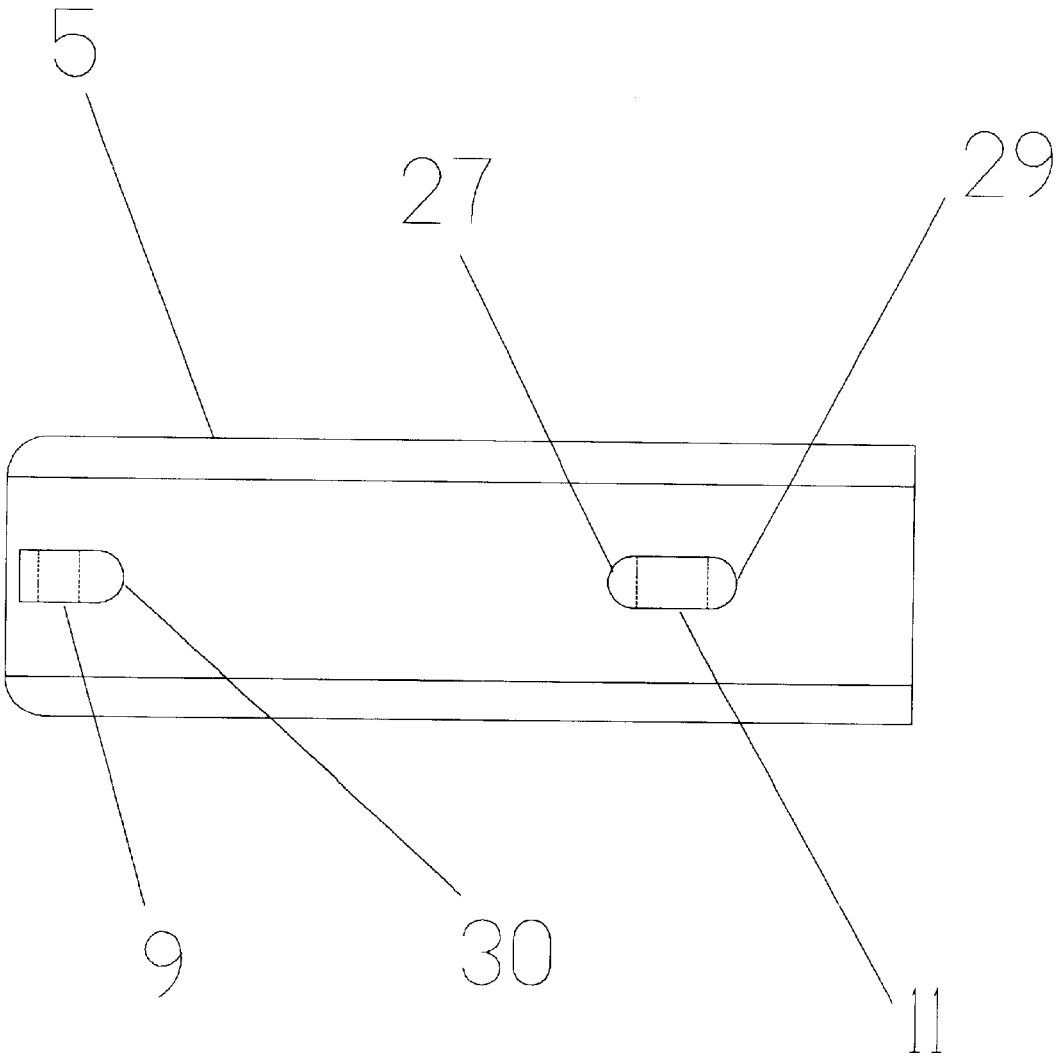
FIG. 7 is a bottom view of the barrel.
Figure 8:
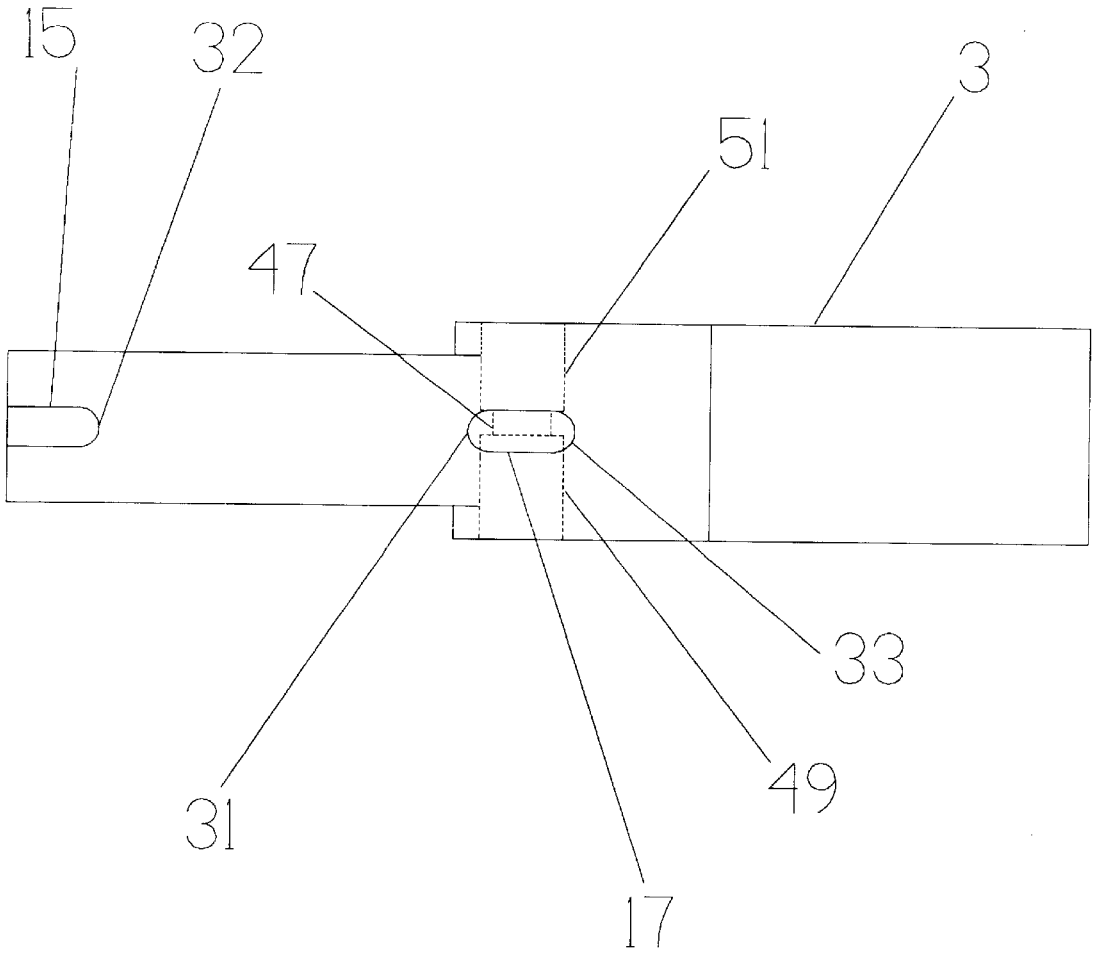
FIG. 8 is a top view of the frame.

FIG. 7 shows that front lug 9 has a rear radius 30. FIG. 7 also shows that rear lug 11 incorporates both a front radius 27 and a rear radius 29. Rear well 17 has a corresponding shape. FIG. 8 shows that rear well 17 has a front radius 31 and a rear radius 33. In addition forward well 15 has a rear radius 32. The radiused shape of rear well 17 allows the well to be cut with a standard end mill and reduces potential stress concentrations.

Figure 5:
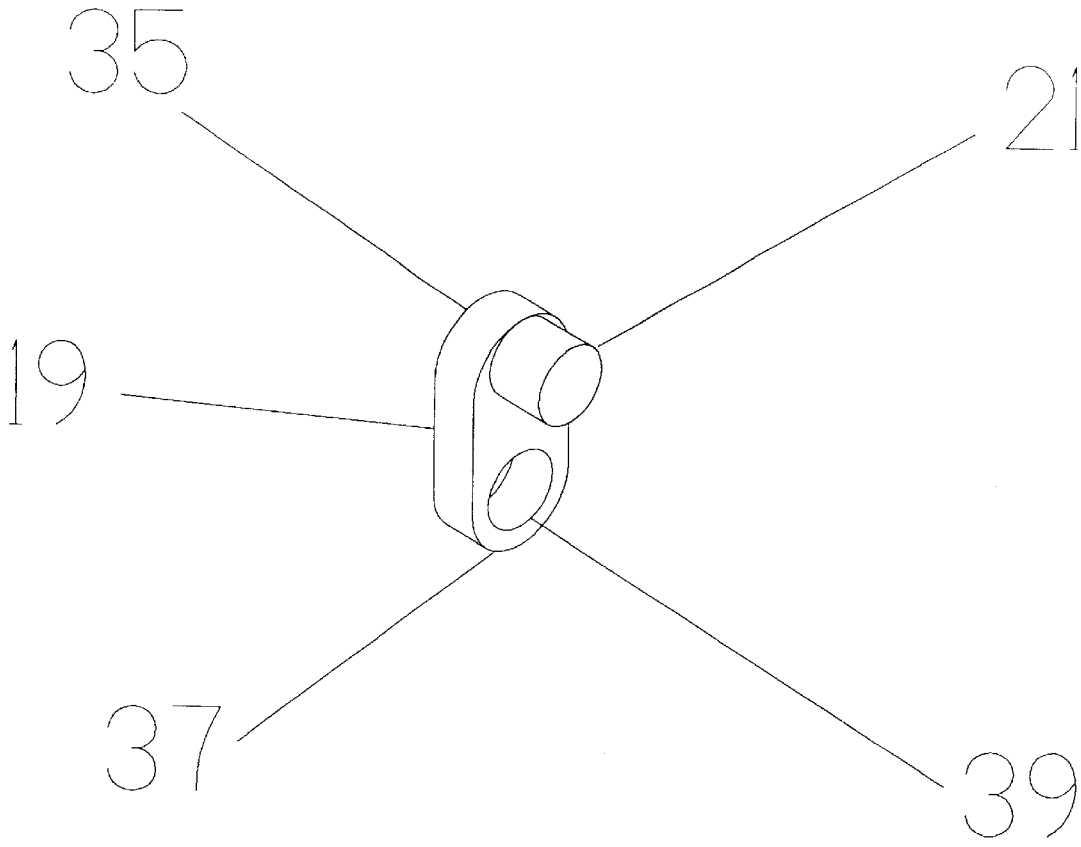
FIG. 5 is an isometric view of the locking piece.

FIG. 5 depicts locking piece 19. Locking piece 19 has both a top radius 35 and a bottom radius 37. Locking stud 21 is cylindrical and tangent to top radius 35. A threaded through hole 39 is provided to accept actuator 23.

Figure 6:
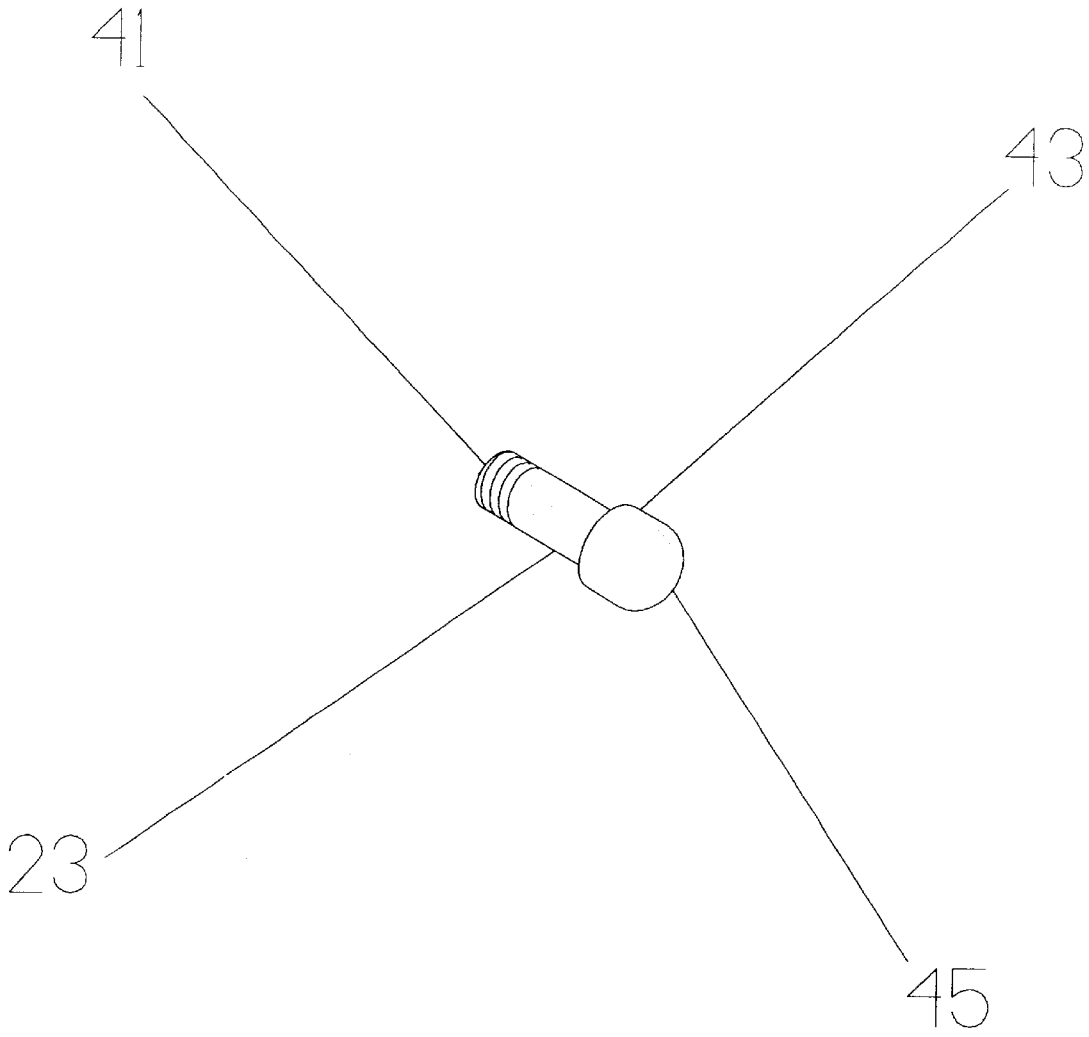
FIG. 6 is an isometric view of the actuator.

FIG. 6 shows actuator 23. Actuator 23 is a cylindrical member having a threaded end 41. Opposite threaded end 41 is a larger diameter head 43 having a fully radiused end which serves as a push button 45.

Figure 9:
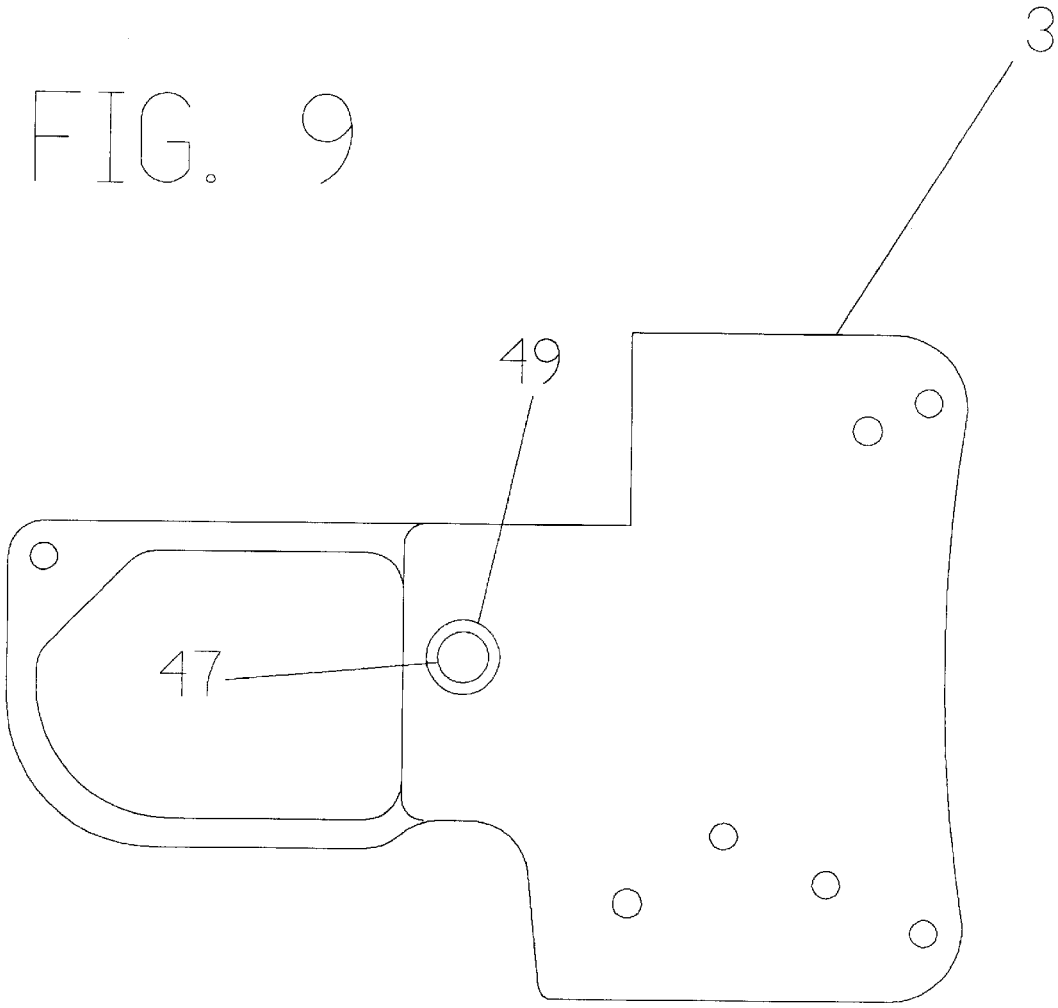
FIG. 9 is a left side view of the frame.
Figure 10:
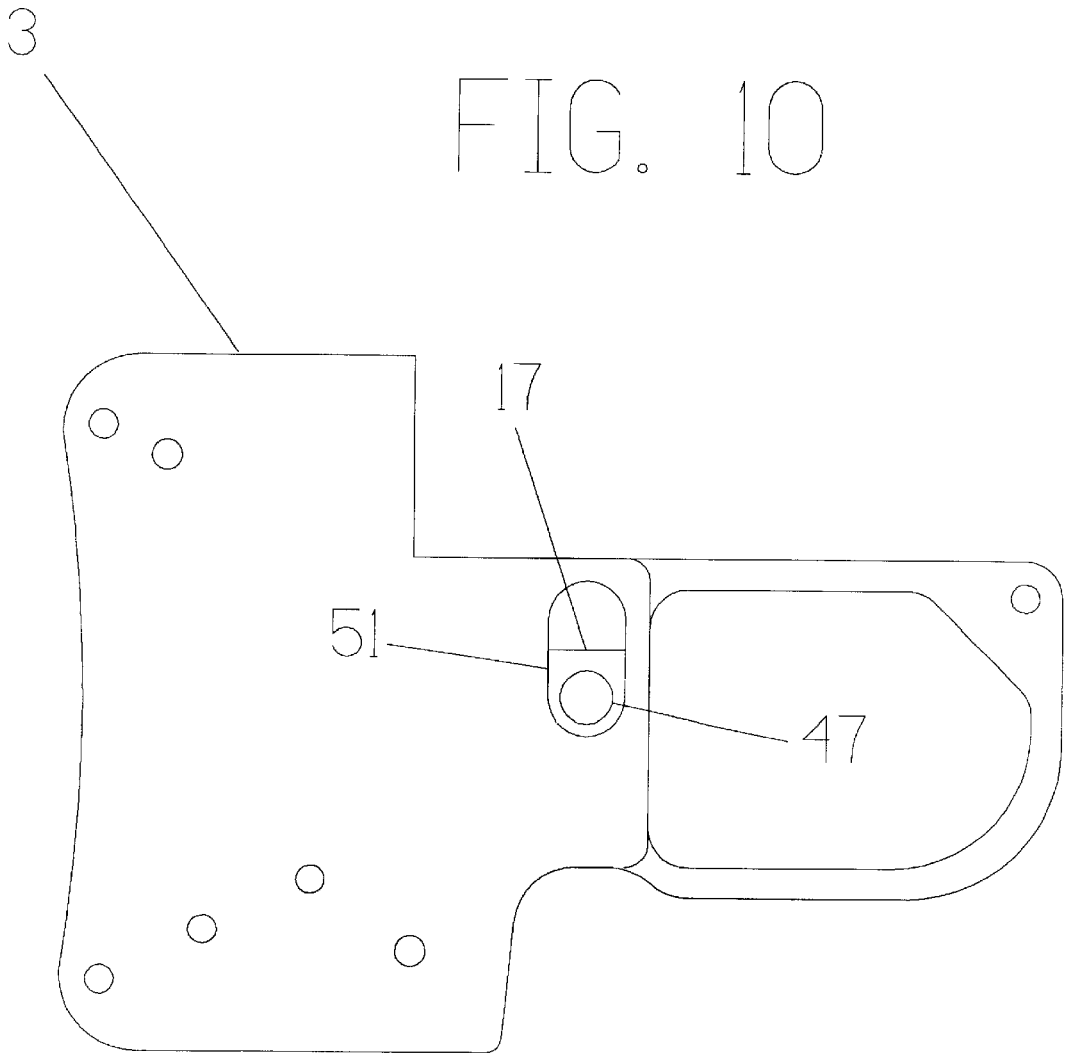
FIG. 10 is a right side view of the frame.

FIG. 9 depicts a through hole 47 and a counterbore 49 in the left side of frame 3. Hole 47 and counterbore 49 accept actuator 23. Moving on to FIG. 10, hole 47 is aligned with a recess 51 designed to accept locking piece 19. Recess 51 is deep enough to provide access to well 17. This geometry is shown as hidden lines in FIG. 8.

Figure 11:
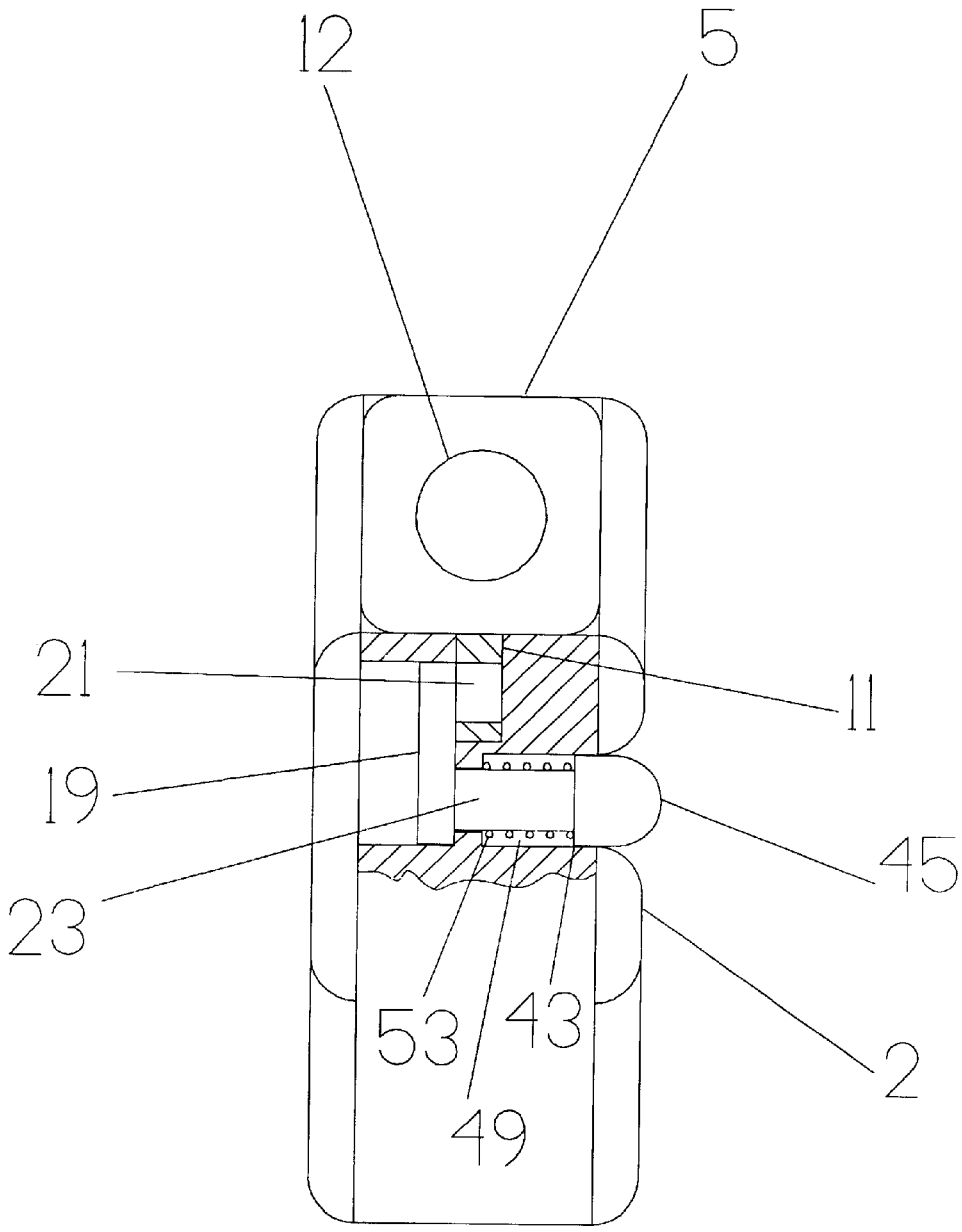
FIG. 11 is a partial sectional front view with barrel locked.

FIG. 11 shows barrel 5 in the locked position. Locking stud 21 engages rear lug 11. Rear lug 11 is centered beneath a barrel bore 12. Locking piece 19 is maintained in the locked position by the force of a helical compression spring 53 which bears upon head 43. Compression spring 53 is located in counterbore 49 and is concentric with actuator 23. Push button 45 is accessible through a relieved portion of right grip plate 2.

Figure 12:
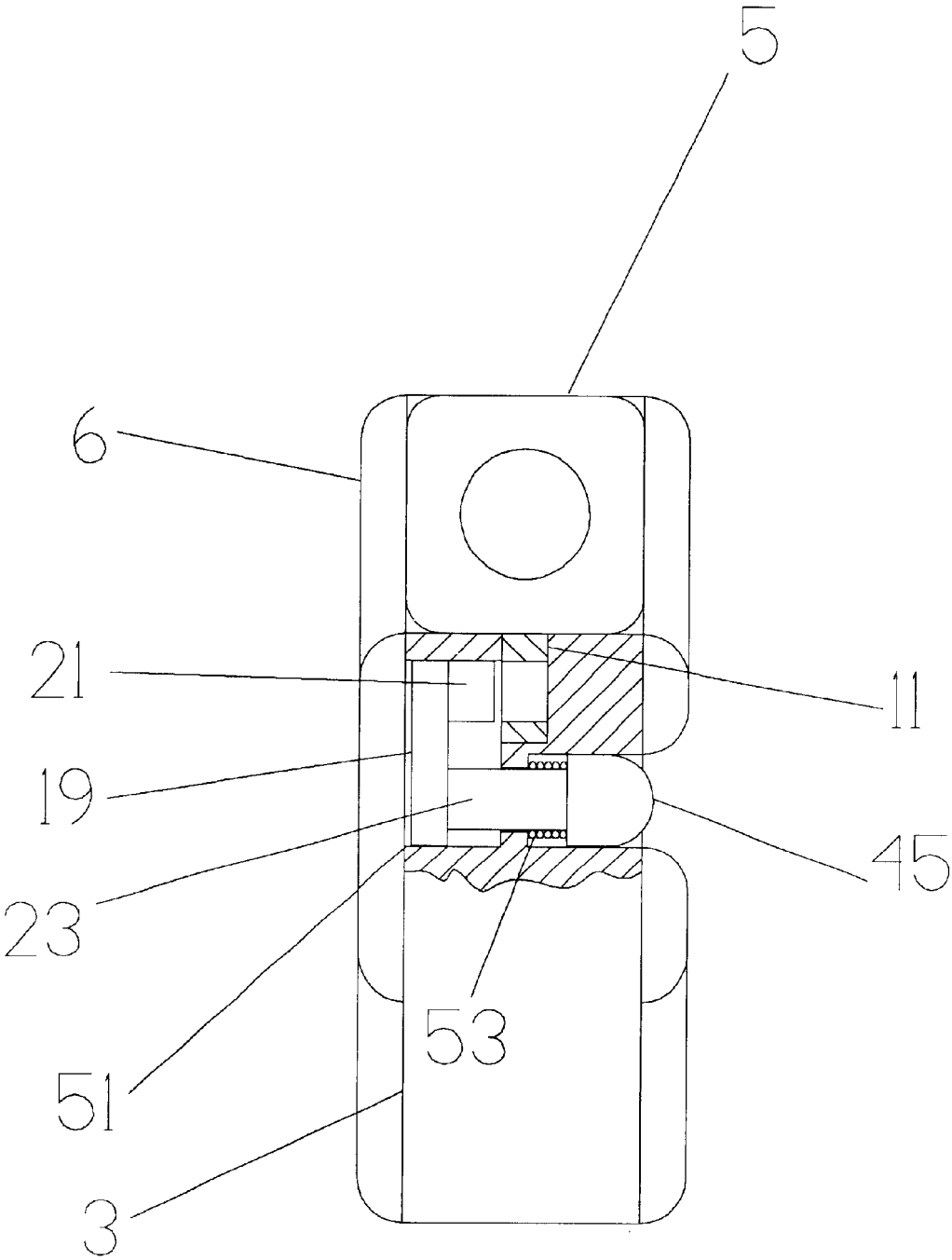
FIG. 12 is a partial sectional front view with barrel unlocked.

FIG. 12 shows barrel 5 in the unlocked position. Adequate force applied to push button 45 transversely translates locking piece 19 such that locking stud 21 is disengaged from rear lug 11. Barrel 5 may now be freely rotated upward for loading. The displacement of locking piece 19 is limited in magnitude such that locking piece 19 does not extend beyond frame 3. This allows locking piece 19 and corresponding recess 51 to be concealed under right grip plate 6.

Figure 13:
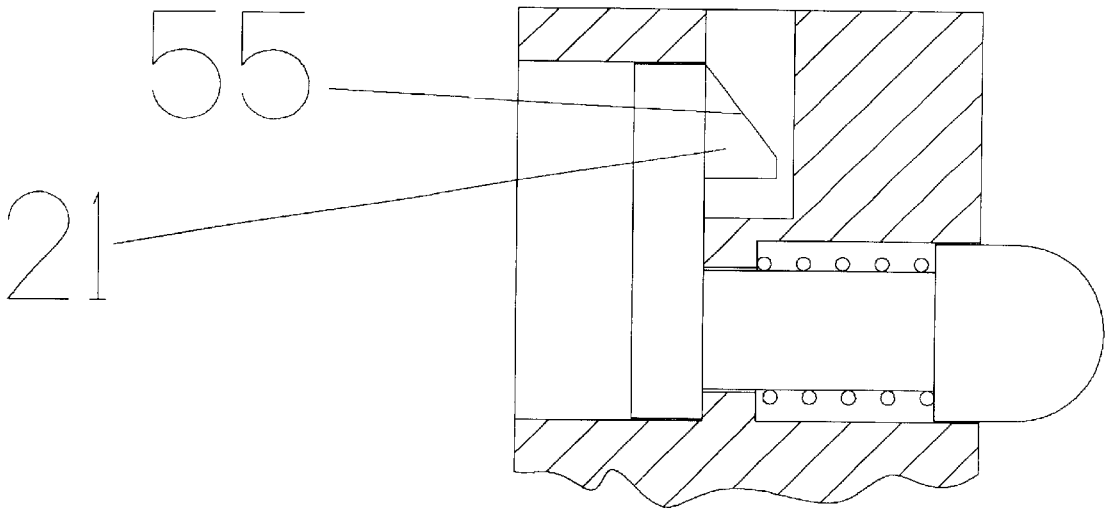
FIG. 13 is a partial sectional front view showing an additional embodiment of the locking stud.

FIG. 13 shows an alternate embodiment. A camming surface 55 has been applied to locking stud 21 to provide for automatic closing of the barrel.

Conclusion, Ramifications, and Scope

Thus, the reader will see that the barrel catch mechanism of this invention is compact and suitable for small handguns, while also providing the robustness and strength required to contain high energy cartridges. In addition, the catch is ergonomically easy to operate, does not interfere with comfortably gripping a small handgun, and is not a design constraint to minimizing handgun height.

Although the description above contains many specificities, these should not be construed as limiting the scope of the invention, but rather as an exemplification of one preferred embodiment thereof. Many other variations are possible. For example, the locking stud can have other cross sectional shapes, such as rectangular, oval, trapedzoidal, etc.; the locking piece can be changed in shape and orientation; the transverse locking force can be provided by a different type of spring; the locking surface of the rear lug can be changed in shape, a portion of the actuator can be made integral with the locking piece, etc.

Accordingly, the scope of the invention should be determined not by the embodiment(s) illustrated, but, by the appended claims and their legal equivalents.

I claim:

1. In a hinged barrel firearm, a barrel catch mechanism comprising a transversely slidable locking piece, said locking piece having a transverse through hole with respect to the longitudinal axis of said firearm.

2. The barrel catch mechanism of claim 1 wherein a push button translates with said locking piece.

3. The barrel catch mechanism of claim 2 wherein said locking piece has a projection which engages a barrel lug.

4. The barrel catch mechanism of claim 2 wherein said locking piece has a projection which enters a barrel lug.

5. In a hinged barrel firearm having a frame, a barrel, and a breech face, a barrel catch mechanism to lock and unlock said barrel, comprising:

a) a transverse through hole in said frame, said through hole connecting a first frame recess to a second frame recess wherein said through hole has a smaller height than either of said frame recesses;

b) a locking piece having a face, said locking piece being transversely slidable within said first frame recess with respect to the longitudinal axis of said firearm;

c) a locking projection extending from said face;

d) an actuator to control the position of said locking piece, said actuator being transversely slidable with respect to the longitudinal axis of said firearm;

e) a positive stop means which prevents said locking piece from extending substantially outside of said first frame recess;

characterized in that said first frame recess has an opening on one side of said frame to accept said locking piece and said actuator is accepted by said second frame recess, such that said transverse through hole provides access for connecting said locking piece and said actuator.

6. The barrel catch mechanisms of claim 5 wherein said through hole has a smaller cross-sectional area than that of said first frame recess or that of said second frame recess.

7. The barrel catch mechanism of claim 5 wherein said first frame recess is located forward of said breech face with respect to the longitudinal axis of said firearm.

8. The barrel catch mechanism of claim 5 wherein said first frame recess is shaped so as to prevent rotation of said locking piece about a transverse axis.

9. The barrel catch mechanism of claim 5 wherein said push button translates with said locking piece.

10. The barrel catch mechanism of claim 7 wherein said push button translates with said locking piece.

11. The barrel catch mechanism of claim 5 wherein said positive stop means prevents said locking piece from extending outside of said first frame recess.

12. The barrel catch mechanism of claim 5 wherein said face has projected area in a transverse direction with respect to the longitudinal axis of said firearm.

13. The barrel catch mechanism of claim 5 wherein said face has greater height than length, length being measured with respect to the longitudinal axis of said firearm.

14. The barrel catch mechanism of claim 5 wherein said face has a radius.

15. The barrel catch mechanism of claim 5 wherein said locking projection is located on the upper portion of said face.

16. The barrel catch mechanism of claim 5 wherein said locking projection is a cantilever.

17. In a hinged barrel firearm having a frame, a barrel, and a breech face, a barrel catch mechanism to lock and unlock said barrel, comprising:

a) a first frame recess and a second frame recess;

b) a locking piece, said locking piece being transversely slidable within said first frame recess with respect to the longitudinal axis of said firearm;

c) an actuator to control the position of said locking piece, said actuator being transversely slidable with respect to the longitudinal axis of said firearm;

d) a positive stop means which prevents said locking piece from extending substantially outside of said first frame recess;

e) a transverse through hole in said frame, said through hole connecting said first frame recess to said second frame recess wherein said through hole has a size which prevents complete passage of said locking piece;

characterized in that said first frame recess has an opening on one side of said frame to accept said locking piece and said actuator is accepted by said second frame recess, such that said transverse through hole provides access for connecting said locking piece and said actuator.

18. The barrel catch mechanism of claim 17 wherein said through hole has a smaller cross sectional area than that of said first frame recess or that of said second frame recess.

19. The barrel catch mechanism of claim 17 wherein said through hole has a smaller height than that of said first frame recess or that of said second frame recess.

20. The barrel catch mechanism of claim 17 wherein said positive stop means prevents said locking piece from extending outside of said first frame recess.

* * * * *